US007131688B2

(12) United States Patent
Steenson

(10) Patent No.: US 7,131,688 B2
(45) Date of Patent: Nov. 7, 2006

(54) ADJUSTABLE ARMCHAIR MOUSE TRAY

(76) Inventor: Daniel V. Steenson, 1546 N. Ellington Way, Eagle, ID (US) 83616

( * ) Notice: Subject to any disclaimer, the term of this patent is extended or adjusted under 35 U.S.C. 154(b) by 11 days.

(21) Appl. No.: 10/921,540

(22) Filed: Aug. 18, 2004

(65) Prior Publication Data

US 2006/0061150 A1 Mar. 23, 2006

(51) Int. Cl.
*A47B 39/00* (2006.01)

(52) U.S. Cl. ..... 297/161; 297/188.2; 297/149; 297/135; 297/145; 297/160; 297/188.18; 108/157.11

(58) Field of Classification Search ..... 297/148, 297/149–150, 153, 135, 160–162, 151, 188.14, 297/188.15, 188.18, 188.2, 411.35, 411.37, 297/149.145; 108/47, 157.11; 248/287.1, 248/286.1, 285.1, 283.1, 311.2
See application file for complete search history.

(56) References Cited

U.S. PATENT DOCUMENTS

| | | | | | |
|---|---|---|---|---|---|
| 0,171,528 | A | | 12/1875 | Musser | |
| 2,034,835 | A | * | 3/1936 | Rubino | 297/161 |
| 2,426,097 | A | * | 8/1947 | Heller | 297/135 |
| 2,692,174 | A | * | 10/1954 | Whitehead | 108/157.11 |
| 2,797,973 | A | * | 7/1957 | Culpepper | 108/157.11 |
| 3,408,032 | A | * | 10/1968 | Francis | 248/450 |
| 3,632,162 | A | * | 1/1972 | Trethaway | 297/149 |
| 3,680,911 | A | | 8/1972 | Dupuis | |
| 4,575,149 | A | * | 3/1986 | Forestal et al. | 297/145 |
| 4,730,869 | A | * | 3/1988 | Schumacher | 297/188.18 |
| 4,815,688 | A | | 3/1989 | Wood | |
| 4,913,393 | A | * | 4/1990 | Wood | 248/230.2 |
| 5,022,706 | A | | 6/1991 | Bryan | |
| 5,035,464 | A | | 7/1991 | Spallholtz | |
| 5,048,428 | A | | 9/1991 | LaRue | |
| 5,169,210 | A | | 12/1992 | Fricano | |
| 5,234,251 | A | | 8/1993 | Ayotte | |
| 5,246,240 | A | * | 9/1993 | Romich et al. | 280/304.1 |
| 5,292,173 | A | | 3/1994 | Lambert | |
| 5,306,071 | A | | 4/1994 | Zamo' et al. | |
| 5,311,210 | A | | 5/1994 | O'Brien et al. | |
| 5,320,313 | A | * | 6/1994 | Crowe | 248/231.61 |
| 5,474,272 | A | | 12/1995 | Thompson et al. | |
| 5,490,710 | A | | 2/1996 | Dearing et al. | |
| 5,505,412 | A | * | 4/1996 | Van Hamme | 248/118 |
| 5,593,128 | A | | 1/1997 | Odom et al. | |
| 5,653,499 | A | | 8/1997 | Goodall | |
| 5,660,432 | A | * | 8/1997 | Davis | 297/182 |
| 5,727,759 | A | | 3/1998 | Christensen | |
| 5,765,911 | A | * | 6/1998 | Sorenson | 297/173 |
| 5,839,713 | A | | 11/1998 | Wright | |
| 5,848,773 | A | | 12/1998 | Bourassa | |
| 5,887,940 | A | | 3/1999 | Anderson et al. | |

(Continued)

*Primary Examiner*—Peter M. Cuomo
*Assistant Examiner*—Erika Garrett
(74) *Attorney, Agent, or Firm*—Frank J. Dykas; Derek H. Maughan; Dykas, Shaver & Nipper, LLP

(57) ABSTRACT

The present invention discloses a multi-functional adjustable mouse tray that mounts on the arm of a chair to provide a comfortably accessible work surface to support and use a computer mouse and other devices. The adjustable tray is easily mounted to either arm of a chair and provides width, length, rotation and storage adjustments. The adjustable tray includes a platform and is pivotally connected to an armchair attachment body. The armchair attachment body includes an armchair stop pivotally connected to the platform, parallel guides that are adjustably attached to the armchair stop, and at least one compression element for securing the parallel guides against the chair arm.

19 Claims, 8 Drawing Sheets

U.S. PATENT DOCUMENTS 5,893,607 A 4/1999 Trimnell
5,899,526 A 5/1999 LaPointe et al.
5,909,922 A * 6/1999 Dugas ..... 297/188.18
6,017,085 A 1/2000 LaCroix et al.
6,027,165 A * 2/2000 Adkins ..... 297/188.18
6,073,997 A 6/2000 Koh
6,092,867 A * 7/2000 Miller ..... 297/188.14
6,213,556 B1 * 4/2001 Chen ..... 297/411.35
6,220,658 B1 4/2001 Lukawski et al.
6,264,272 B1 * 7/2001 Jones et al. ..... 297/173
6,314,891 B1 * 11/2001 Larson ..... 108/44
6,352,303 B1 * 3/2002 Hope ..... 297/188.18
6,478,371 B1 11/2002 Clarke
6,554,354 B1 4/2003 Hoffman et al.
6,554,364 B1 * 4/2003 Dammermann et al. ..... 297/411.37
6,773,060 B1 8/2004 Sher et al.
6,827,405 B1 * 12/2004 Roberts ..... 297/411.23
6,935,683 B1 * 8/2005 Brown ..... 297/188.2

* cited by examiner

ADJUSTABLE ARMCHAIR MOUSE TRAY

BACKGROUND OF THE INVENTION

1. Field of the Invention

The present invention generally relates to the field of computer accessories. More particularly, the present invention provides an adjustable tray that may be easily mounted to the arm of a chair to provide a flat working surface to support a computer mouse and other accessories, devices and objects.

2. Background Information

Computers are operated through the use of peripheral systems and devices such as the keyboard and the mouse. These devices enable a user to interact with a computer to input information, make decisions, and carry out various other functions. Direct physical contact with, and therefore close proximity to, these devices are essential to their operation.

However, in most circumstances a computer user works at a desk and leans forward or sideways from a comfortable sitting position to reach a keyboard or mouse on a desk or other flat surface. Reaching for the keyboard or the mouse in this way makes it very difficult to maintain proper posture and operate the computer comfortably. Use of a computer mouse on a desktop stresses the back, shoulder and the wrist. For wrist stress and carpal tunnel syndrome, numerous products, such as ergonomically shaped mice and wrist supports, attempt to address the symptoms of this stress without addressing the awkward positioning that often causes strain. Additionally, persons with debilitating injuries may find that reaching to a desk to use a keyboard and mouse is difficult or painful.

The physical stresses resulting from the awkward positioning and use of a mouse on a desk top may be remedied by mounting an adjustable platform to the left or right arm of a chair in order to facilitate the operation of a mouse or other input device as a natural extension of a person's arm from a comfortable seated position. An adjustable platform that can be quickly and efficiently mounted to the arm of a chair may facilitate comfortable use of a computer keyboard on a person's lap without reaching for the mouse, or use of the keyboard on the platform itself, further correcting the hunched forward position of many computer users.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

These and other objects of the present invention are accomplished by an adjustable mouse tray for use on the arm of a chair. As used herein, the adjustable armchair mouse tray is referred to simply as an adjustable tray. The adjustable tray includes a platform that provides a flat working surface particularly suited for operation of a computer mouse. The platform is rotatably fastened to a chair arm attachment body, which is adjustable to fit various styles, widths and lengths of chair arms.

The platform preferably has at least one slot defined within the platform through which the platform is fastened to the chair arm attachment body. The platform also preferably includes retaining elements around its perimeter to prevent devices from sliding off the platform, and mouse pad retainers to retain a mouse pad on the platform when the platform is rotated and stored to the side of the chair.

The main components of the chair arm attachment body are an armchair stop, parallel guides and compression elements. The armchair stop supports the platform for use and storage, and connects the platform to the parallel guides that mount on the arm of a chair. The armchair stop preferably defines a groove, cavity or interconnecting groove by which the armchair stop is pivotally connected by a rotational fastener to the platform through one of the slots in the platform. This interconnection allows the platform to slide and rotate within the horizontal plane for use, and within the vertical plane for storage of the platform to the side of a chair.

The chair arm attachment body includes parallel guides for allowing the adjustable tray to be mounted to the chair arm. The chair arm attachment body includes at least one compression element for securing the parallel guides to sides of the chair arm. The manner of compression presents various embodiments of the adjustable tray. In one embodiment, the parallel guides are slidably secured to the armchair stop by a widening rail allowing width adjustments for differently sized chair arms. Corresponding vertical guides are also slidably secured to the parallel guides by at least one lengthening rail for length adjustments. A bottom support element with a vertical slot is secured between the vertical guides for securing the adjustable holder against the bottom of a chair arm.

In another preferred embodiment, the adjustable tray does not incorporate the vertical guides or the widening rail and corresponding elements previously described. The parallel guides are slidably interconnected to the armchair stop and fixed therein and against the chair arm by at least one securing device. The securing device is preferably a strap with a buckle for easy attachment. In some versions of the strapped embodiment, the parallel guides may also be slidably connected to the armchair stop by a widening rail.

The adjustable tray is preferably adjustable to various sizes of chair arms. The adjustable tray may also include a mouse pad surface disposed on the platform and supported by the retaining elements and mouse pad retainers. Cushioning material may be used on the armchair stop, the plurality of parallel guides, the plurality of vertical guides and the bottom support member to prevent movement of the adjustable tray or marring of the chair during use.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein only the preferred embodiments of the invention will be described and shown, simply by way of illustration of the best modes contemplated to manifest the invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
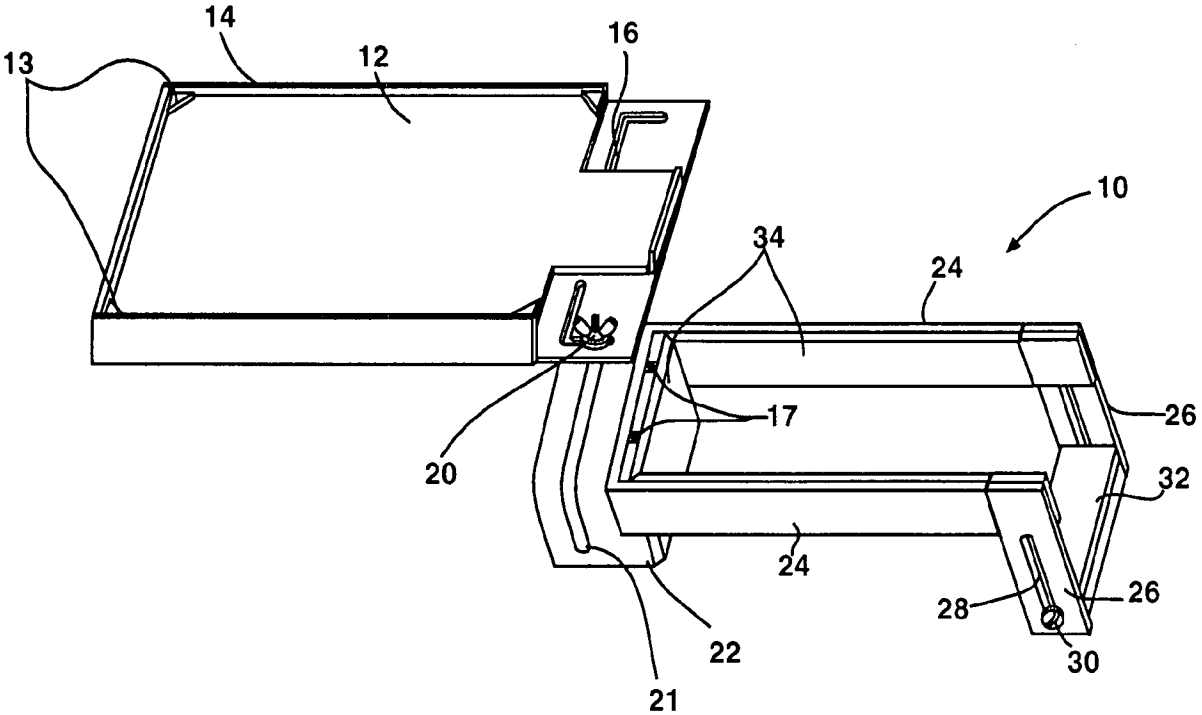
FIG. 1 is a perspective view of a preferred embodiment of an adjustable tray.

While the invention is susceptible to various modifications and alternative constructions, certain illustrated embodiments thereof have been shown in the drawings and will be described below in detail. It should be understood, however, that there is no intention to limit the invention to the specific forms disclosed, but, on the contrary, the invention is to cover all modifications, alternative constructions, and equivalents falling within the spirit and scope of the invention as defined in the claims.

The present invention is an adjustable tray that may be mounted on various types of chair arms. Although as many different uses are available for the present invention as there are uses for chairs, the present invention will commonly be referenced as an adjustable tray. FIG. 1 shows a perspective view of the adjustable mouse tray 10. In each preferred embodiment, the adjustable tray 10 includes a platform 12. The platform 12 provides a flat surface for devices such as a roller and optical mouse, pen, joystick, keyboard, keypad or roller ball. Additionally, the platform may be used to write notes, secure a remote control, hold food or a beverage, or facilitate other similar uses. The adjustable tray 10 may be used on any device or location that is equipped with a chair arm or substantial equivalent. For example, many automobile seats are now equipped with armrests that the adjustable tray 10 would easily adapt to fit for previously mentioned uses.

The platform 12 and other parts of the adjustable tray 10 may be built or molded of any material that allows for strength and ease of use such as wood, plastic or other similar materials. In each preferred embodiment, the platform 12 incorporates multiple retaining elements 14, preferably located around the periphery of the platform 12, to allow a mouse, mouse pad surface or other device to be retained within the perimeter of the platform 12. The retaining elements 14 provide a boundary that prevents a mouse, writing utensil, notebook, personal digital assistant, cell phone or other device from falling off the platform 12. In each preferred embodiment, the retaining elements 14 may be placed on all sides of the platform 12 to assure that the mouse does not fall off any side of the platform.

A mouse pad or other similar material may be positioned on top of the platform 12 and configured to be easily replaced when worn out. The mouse pad used, which may be supported by the platform 12, is preferably similar to those used for basic stand-alone computer mouse pads, typically neoprene. Additionally, the mouse pad may be rubber, plastic or other material that facilitates the operation of a roller ball mouse, optical mouse or other similar computer-interfacing device. A mouse pad that is placed on the platform may be held in place by multiple mouse pad retainers 13. The mouse pad retainers 13 prevent a mouse pad inserted on the platform 12 from falling off when the adjustable tray 10 is placed in a stored or disengaged position. In one embodiment, the mouse pad retainers 13 are tabs that are placed in the corners of the platform 12 that secure the mouse pad between the mouse pad retainers 13 and the platform 12. In other embodiments, the mouse pad retainers 13 could be a molded part of the platform or clamps, tie downs, Velcro, snaps or other elements that could similarly maintain the correct positioning of the mouse pad on the platform 12.

Figure 2:
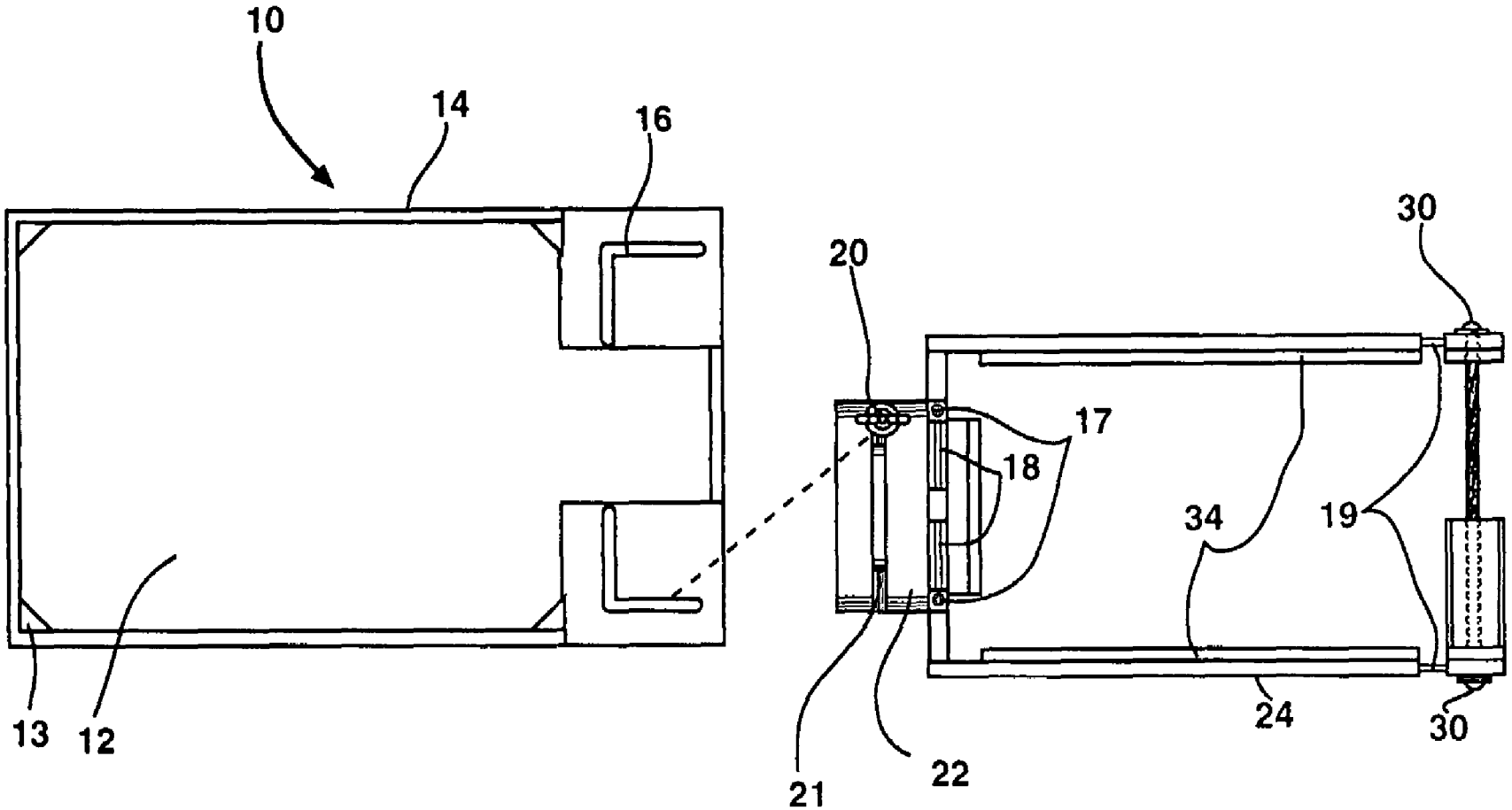
FIG. 2 is a top view of the embodiment of FIG. 1.

FIG. 2 is a top view of the preferred embodiment of FIG. 1. FIG. 2 shows the main elements of the adjustable tray, the platform 12 and the chair arm attachment body disconnected from one another. In this embodiment, the platform 12 includes at least two slots 16 on either side of the platform 12 that pass through the entire platform 12. Returning again to FIG. 1, these slots 16 allow a chair arm attachment body to be interconnected with the platform 12 through use of a rotational fastener 20. As herein defined, a rotational fastener 20 is a threaded nut and bolt, a pin connection with a threaded end for tightening purposes, or any other element that provides a rotational pivot for the angular adjustment of the platform 12 while still interconnecting the platform 12 with the chair arm attachment body.

The rotational fastener 20 is preferably ergonomically designed or covered so that it does not interfere with the user during use of devices on the adjustable tray 10. This may be accomplished by incorporating a rounded or other shape that allows it to be easily tightened while simultaneously maintaining the ergonomic features.

Multiple slots 16 defined within the platform 12 increase the adjustable tray's 10 ability to be adjusted allowing the platform 12 to be connected to a chair arm attachment body through either side of the platform 12 according to the user's preference. The multiple slots 16 also allow the platform 12 to slide and pivot horizontally from either of the slots 16 selected by the user providing a more ergonomic use of the adjustable tray 10. In one embodiment, the slots 16 are L-shaped and in yet another embodiment, the slots 16 are curved. The slots 16 may be any shape that allows the platform 12 to be rotated and slid into an ergonomically friendly orientation. The multiple slots 16 similarly facilitate the use of the adjustable tray 10 by right or left-handed users on either arm of a chair.

Figure 3:
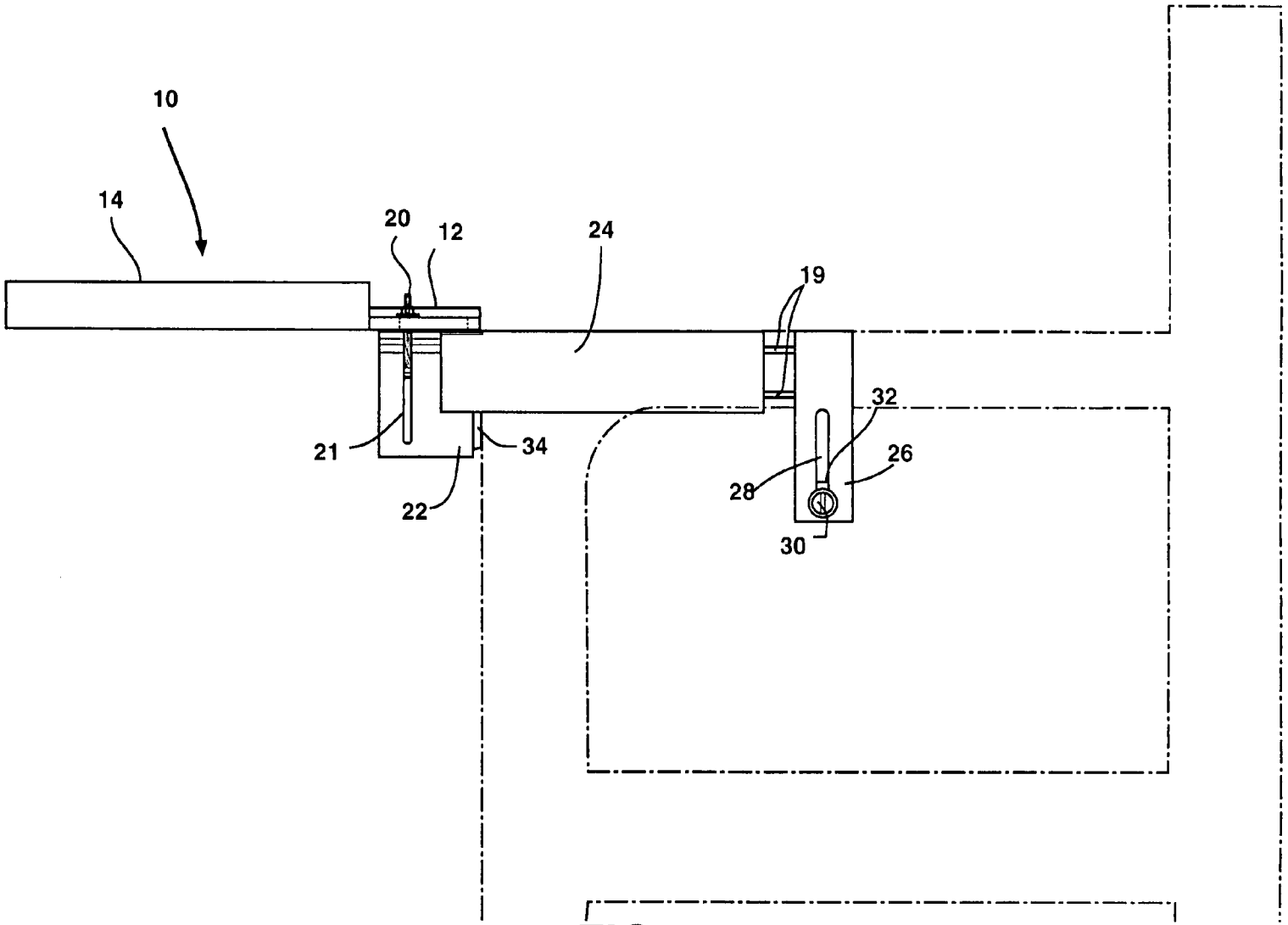
FIG. 3 is a side view of the embodiment of FIG. 1 as mounted on a chair arm.
Figure 4:
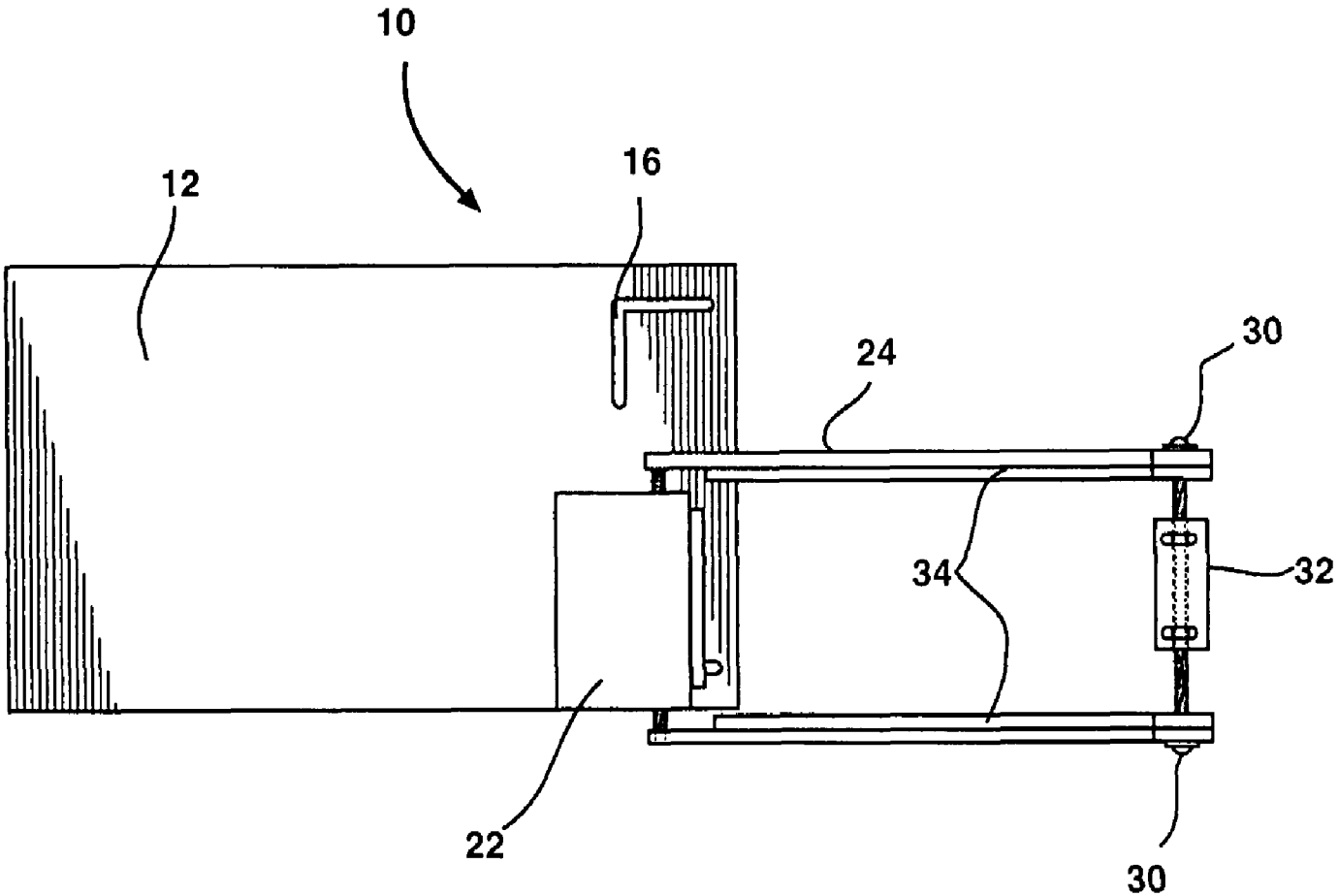
FIG. 4 is a bottom view of the embodiment of FIG. 1.

FIG. 3 is a side view of the embodiment of FIG. 1 as mounted on a chair arm. One main component of the chair arm attachment body is an armchair stop 22. The armchair stop 22 allows the adjustable tray 10 to be positioned directly against the end of the arm of the chair. In some cases, that will be where the armrest transitions from horizontal to vertical. The adjustable tray 10 will also work on different styles of arms and chairs with the only general compatibility requirement being that the chair has an armrest equivalent. FIG. 4 is a bottom view of the embodiment of FIG. 1. In one embodiment, the armchair stop 22 extends normally to the connected platform 12. The normal extension of the armchair stop 22 allows it to mimic and closely fit the perpendicular elbow transition or end of most chair arms. In another embodiment, the armchair stop 22 extends at an angle or slope rather than a normal extension from the platform 12 to better-fit chairs with sloped arms.

Figure 5:
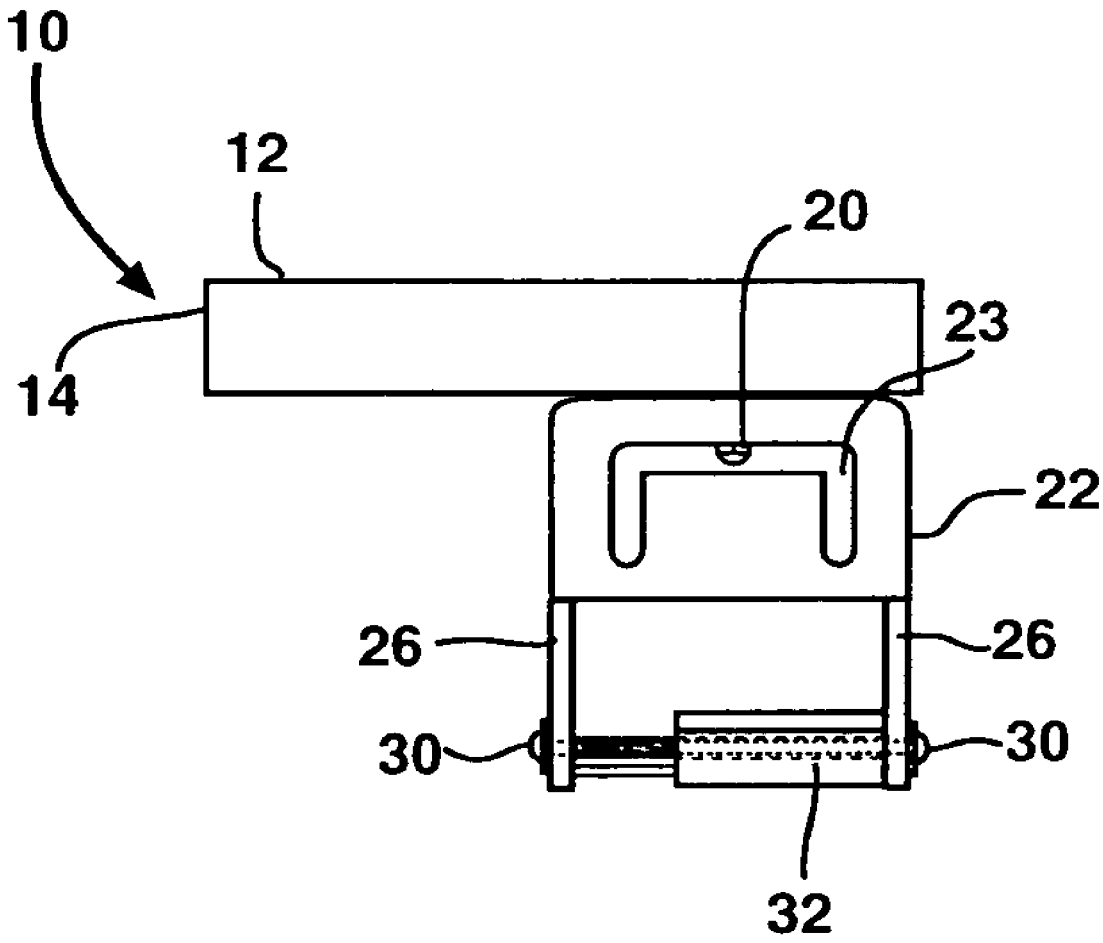
FIG. 5 is a front view of the embodiment of FIG. 1.

FIG. 5 is a front view of the embodiment of FIG. 1. The rotational threaded fastener 20 passes through the slotted surface 16 of the platform 12, down through an outer stopper groove 21, in by the chair stop 22, into an inner stopper groove 23 in the armchair stop 22. The outer stopper groove 21 in the armchair stop 22 is disposed both horizontally where the armchair stop 22 makes contact with the platform 12 and vertically along the periphery of the stop 22 where the platform may be stored, and is best seen in FIGS. 2 and 3.

The inner stopper groove 23, as shown in FIG. 5, is disposed on the front most surface of the armchair stop 22. The inner stopper groove 23 is disposed in a pattern that mimics the flattened arch shape of the outer stopper groove 21 to form and define an inner cavity within the armchair stop 22 that is approximately the shape of a flattened arch. As shown in the FIGS. 1 and 5, a "flattened arch" has approximately straight vertical and horizontal segments, connected by arcs. The outer stopper groove 21 and the inner stopper groove 23 allow the rotational threaded fastener 20 to be passed between the platform 12 and between the armchair stop 22, securing them together. The rotational threaded fastener 20 operates as a horizontally pivoting hinge allowing the platform 12 to be easily adjusted in either direction of the horizontal plane for use, and the vertical plane for storage.

Because the outer stopper groove 21 and inner stopper groove 23 are disposed in the shape of a flattened arch, the adjustable tray 10 can be mounted to the arm of a chair from directly above and then the platform 12 can be rotated to the side for storage. As a result, a person may use the adjustable tray 10 with the platform horizontal and then rotate the platform and corresponding threaded fastener 20 within the outer stopper groove 21 so that the platform is in a vertical storage position. The transition is easily made by loosening the rotational threaded fastener 20 slightly, and then sliding the fastener 20 and connected platform within the outer stopper groove 21 from the horizontal plane to the vertical plane. In another embodiment, the armchair stop 22 defines only a single groove or cavity that allows a rotational fastener 20 to be similarly connected.

Returning again to the top view of FIG. 2, the chair arm attachment body further includes at least two parallel guides 24 slidably connected to the armchair stop 22. The parallel guides 24 may be tightened against the chair arm using compression. The methods by which compression of the parallel guides 24 is achieved gives rise to multiple embodiments. In one embodiment, the parallel guides 24 are connected to the armchair stop 22 by at least one widening rail 18. The parallel guides 24 secure the arm of a chair between them. When mounted to the chair, the parallel guides 24 run horizontally parallel along the width of the arm of the chair. The widening rail 18 allows the parallel guides 24 to be extended from the armchair stop 22 so that the parallel guides 24 can be adjusted to abut the inner and outer surfaces of chair arms of different widths. The parallel guides 24 also preferably include rail fasteners 17 to secure the parallel guides 24 on the widening rail 18. In some embodiments, the rail fasteners 17 are simply screws that tighten against the widening rail 18 preventing motion. In other embodiments, the rail fasteners 17 might include pins, clamps or other similar securing devices. Frequently, the arm of a chair will be wider than parallel guides at their narrowest or default position against the armchair stop 22. In those circumstances, the user may slide the parallel guides 24 to a width adequate to be properly mounted on the arm of the chair. At that point the user may use the rail fasteners 17 to secure the parallel guides 24 against the widening rail 18.

Connected to the ends of the parallel guides 24 are at least two vertical guides 26. Returning again to the perspective view of FIG. 3, the parallel guides 24 are preferably attached to the vertical guides 26 by at least one lengthening rail 19. The lengthening rail 19 slidably connects the parallel guides 24 to the vertical guides 26. Each vertical guide 26 defines a vertical slot 28. A bottom support element 32 is supported between the vertical guides 26 by threaded fasteners 30 through each guide. As a result, the bottom support element 32 may be moved the length of the vertical slot 28, allowing the bottom support element 32 to be adjusted to fit the thickness of the arm of a selected chair. The lengthening rail 19 allows the vertical guides 26 to be slidably extended in the event a support member of a chair is located so that the bottom support element 32 is unable to pass between the parallel guides 24. When tightened, the bottom support element 32 prevents shaking or other movement during use of the adjustable tray 10. In additional embodiments, the tightening cradle formed by the vertical guides 26 and the bottom support element 32 may be replaced by a belt strap, open clamp, tie, Velcro or other similar securing element. As can be seen from FIG. 3, the securing element that forms the tightening cradle must contact the bottom surface of the chair arm to securely attach adjustable tray 10.

The armchair stop 22, parallel guides 24, vertical guides 26 and bottom support element 32 are preferably lined with a cushioning material 34. The cushioning material 34 allows the parallel guides 24 and vertical guides 26, as well as the bottom support element 32 and armchair stop 22, to be tightened against the surface of a chair without scratching or other marring of the chair. This cushioning 34 also provides a non-slip surface that prevents movement during the use of the adjustable tray 10. The cushioning 34 may be any material such as rubber, plastic or cloth that prevents slippage and marring of the arm of the chair. In one preferred embodiment, the cushioning 34 is neoprene or other non-skid rubberized material used to form traditional stand-alone mouse pads.

The bottom support element 32 connection between the vertical guides 26 is width adjustable using a threaded fastener 30 allowing the adjustable tray 10 to be tightened against various widths of chair arms. The bottom support element 32 may incorporate threads to allow a single or multiple threaded fasteners 30 to support it.

Figure 6:
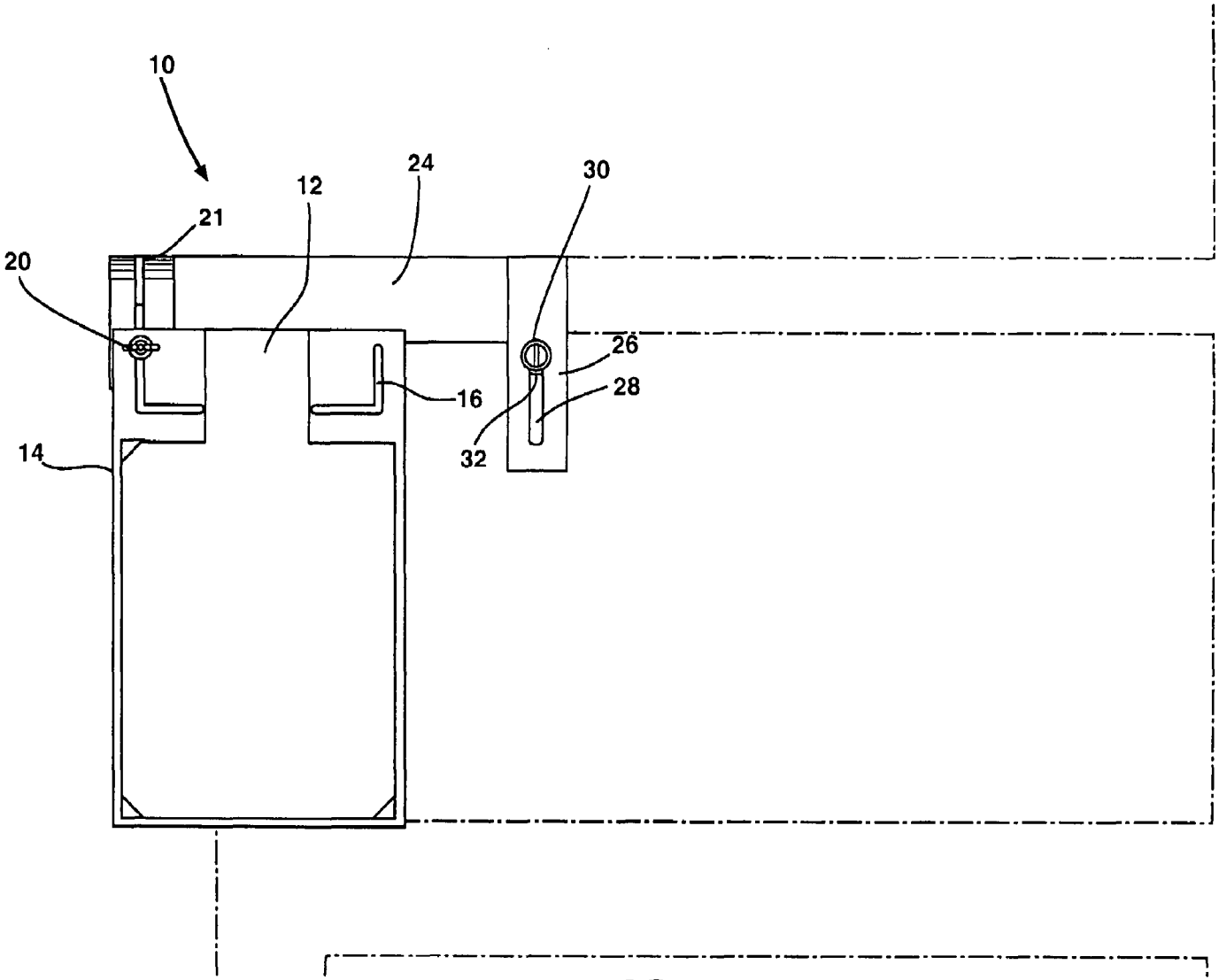
FIG. 6 is a side view of the embodiment of FIG. 1 in a stored position.

FIG. 6 is a side view of the preferred embodiment shown in FIG. 1 in a stored position. The armchair stop 22, with its defined outer stopper groove 21 and inner stopper groove 23, allows the adjustable tray 10 to be mounted directly on top of the chair arm and allows the platform 12 to be rotated and stored on either side of the armchair stop 22. The slots 16 defined by the platform 12 are preferably disposed on the left and right sides. This allows the rotational threaded fastener 20 to be inserted through either of these slots 16. As a result, the adjustable tray 10 can be mounted, used and stored on either the left arm or right arm of an armchair. When not in use, for convenience, a user may loosen the fastener 20 and slide the connected platform 12 to either side of the chair arm for storage.

Figure 7:
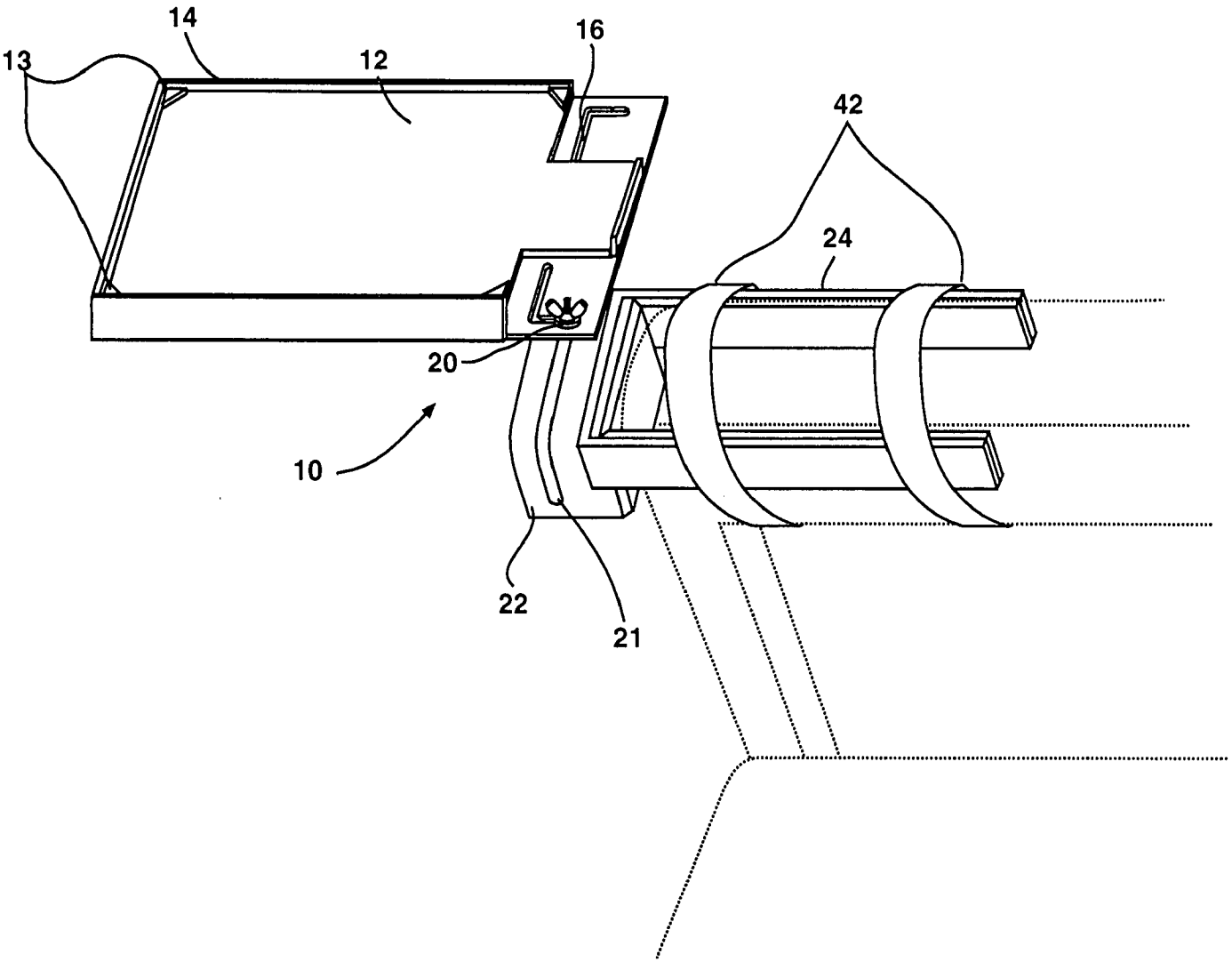
FIG. 7 is a perspective view of another preferred embodiment of the adjustable tray.

FIG. 7 is a perspective view of another preferred embodiment of the adjustable tray. The present embodiment differs in the manner of compressing the parallel guides 24. In this embodiment, straps 42 or other securing devices secure the parallel guides 24 against the sides of the chair arm. As a result, there is no need for lengthening rails, vertical guides or the bottom support member. As with the preferred embodiment, the adjustable tray 10 and corresponding parallel guides 24 may incorporate the widening rail and rail fasteners adjustably fixed to the armchair stop described in the previous embodiment.

In the preferred embodiment depicted in FIG. 7, the parallel guides 24 are secured against the sides of the chair arm by at least one securing device 42. The securing device 42 as herein defined includes, but is not limited to a clamp, tape, bungee cords, string, tie cords, straps, buckles, Velcro, Tabler buckles and clips. The parallel guides 24 are preferably strapped to the sides of the chair arm by securing straps that pass around the chair arm and parallel guides 24 and are fastened by buckles attached to the ends of the securing straps in this preferred embodiment.

Figure 8:
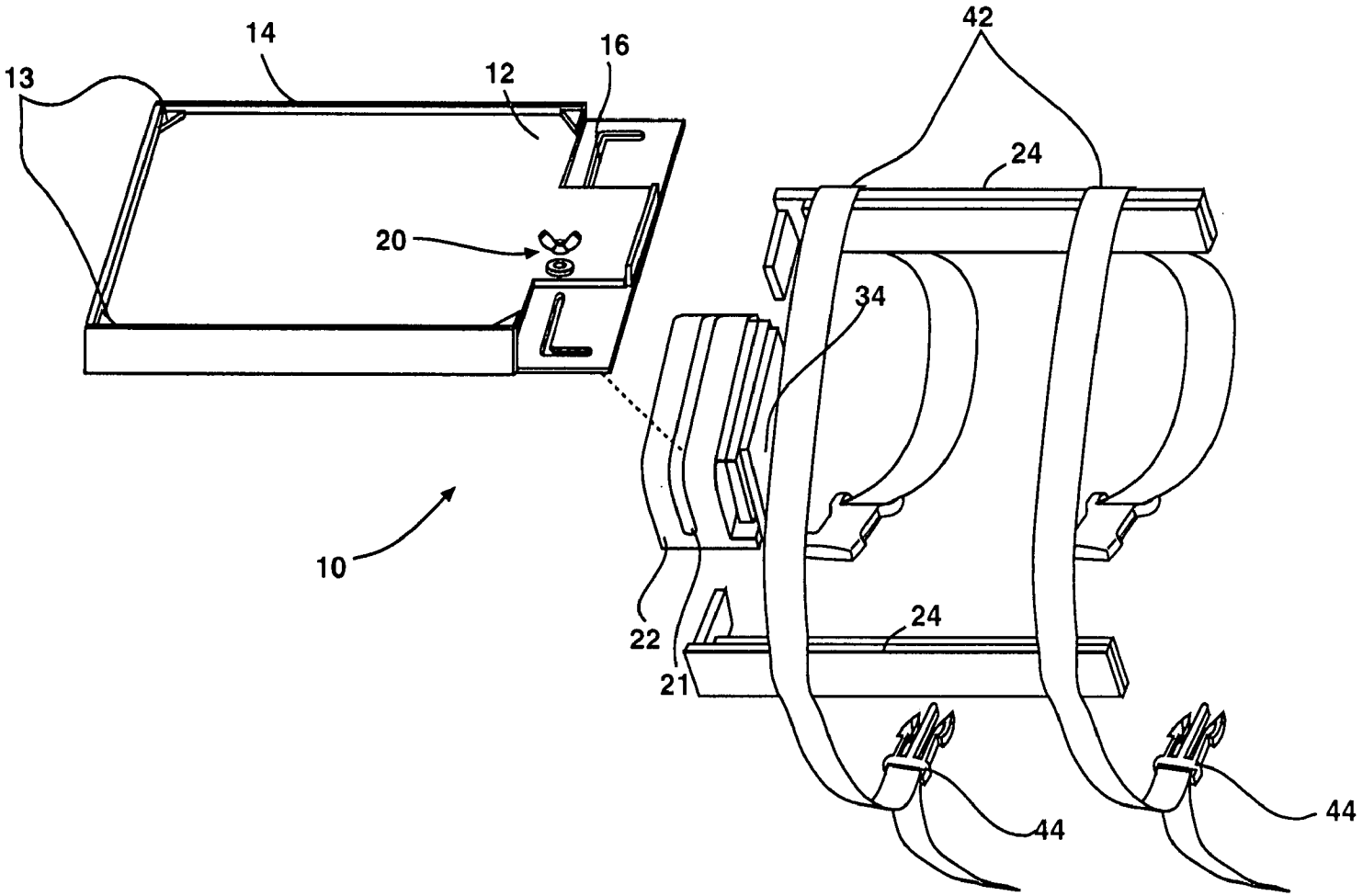
FIG. 8 is a perspective exploded view of the embodiment of FIG. 7.

FIG. 8 is a perspective exploded view of the strapped embodiment of FIG. 7. As shown, the parallel guides 24 may slide within the armchair stop 22. The compression force of the straps 42 presses the parallel guides 24 against the chair arm and into the armchair stop, effectively securing the adjustable tray 10 from moving.

Another embodiment of the strapped embodiment may include at least one strap slot in each parallel guide 24 in which to thread the securing strap(s) 42 to compress and secure the parallel guides 24 to the chair arm. The strap slots preferably run a substantial length of the parallel guides 24 allowing the securing straps 42 to be slid or moved to accommodate the configuration of the chair arm and particularly the support members. The securing strap 42 may be secured in many ways including being tied, buckled, secured with a Tabler buckle, Velcro, clips or other similar attachment means.

In the preferred embodiment, adjustable buckles 44 attached to the securing straps 42 allow the straps 42 to be positioned and then buckled and/or tightened to snugly fit the chair arm. As before, the parallel guides 24 may include cushioning material 34 for stabilization and to prevent scratching. The securing straps 42 allow similar functionality. The present embodiment provides the advantage of simplicity and allows the adjustable tray 10 to be quickly and easily mounted to the chair arm without much effort. The straps 42 allow the parallel guides 24 to be more evenly tightened along the length of the chair arm for better surface contact and adjustable tray 10 stability. Because the parallel guides 24 are open at the opposite end of the armchair stop 22, the adjustable tray 10 is easily positioned on the chair arm.

In an additional embodiment the parallel guides 24 may include tabs, loops or multiple slots positioned along the parallel guide 24 that would be used to accomplish the securing features of the strap slots 42 described above. In another preferred embodiment, the parallel guides 24 tighten against the chair arm by independent straps fastened about the adjustable tray 10.

While there is shown and described the present preferred embodiments of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. An adjustable tray for use on a chair arm comprising:

adjustable platform means for providing a flat working surface;

stopping means pivotally connected to said platform means to secure said platform means against said chair arm while allowing said platform means to rotate in horizontal and vertical planes;

parallel guide means;

width adjustment means that allow the distance between said parallel guides to be varied for adjustably securing said parallel guide means to said stopping means;

compression means fastened around said parallel guide means for adjustably securing said parallel guide means to said chair arm; and a slideable rotational fastener that is capable of moving from a vertical in-use position on top of said stopping means to a horizontal storage position on either side of said stopping means, wherein manual manipulation of said fastener from a top position is permitted in said vertical in-use position to allow rotation, selective adjustment and use of said adjustable platform about a vertical axis in a horizontal plane on top of said stopping means and in front of said chair arm, and wherein manual manipulation of said fastener from a side position is permitted in said horizontal storage position to allow rotation, selective adjustment and storage of said adjustable platform about a horizontal axis in a vertical plane on either side of said stopping means and chair arm.

2. The adjustable tray of claim 1 further comprising cushioning means covering any of said stopping means, guide means or compression means for preventing marring of said chair arm.

3. The adjustable tray of claim 1 wherein said compression means are secured to said parallel guide means for attaching said parallel guide means to said chair arm.

4. The adjustable tray of claim 1 wherein said platform may be rotated about said stopping means and stored vertically along the side of said chair arm.

5. An adjustable tray, for use on a chair arm, said chair arm having a width dimension, a top surface and a bottom surface, said adjustable tray comprising:

a platform having a flat working surface, said platform selectively pivotally connected to an attachment body for securing said adjustable tray to said chair arm, said attachment body comprising:

an armchair stop for supporting and storing said platform wherein said platform is pivotally adjustably connected to said armchair stop by a slideable rotational fastener that is movable from a vertical orientation, wherein said fastener is capable being manually manipulated from a top position to allow rotation, selective horizontal adjustment and use of said platform about a vertical axis when said platform is on top of said armchair stop and in front of said chair arm, to a horizontal orientation wherein said fastener is capable of being manually manipulated from a side position to allow rotation, selective vertical adjustment and storage of said platform about a horizontal axis when said platform is placed on either side of said armchair stop, thus allowing said platform to rotate in a horizontal plane and be stored in a vertical plane;

at least two parallel guides adjustably connected to said armchair stop to mount and secure the adjustable tray to fit the width dimension of said chair arm; and at least one compression element which passes around said at least two parallel guides to compress and secure said parallel guides to said chair arms, wherein said top surface of said chair arm is not covered when said adjustable tray is in place upon a chair arm.

6. The adjustable tray of claim 5 wherein said platform further defines at least one slot for allowing said platform to be selectively attached to said armchair stop through said slot.

7. The adjustable tray of claim 5 wherein said parallel guides further define at least one slit for allowing at least one securing structure to pass through said slit to fasten said parallel guides to said chair arm.

8. The adjustable tray of claim 5 wherein said at least one compression element is selected from the group consisting of a clamp, tape, bungee cord, string, tie cord, strap, buckle, hook and loop fasteners, Tabler buckle and clip, and said at least one compression element securely contacts the bottom surface of said chair arm.

9. The adjustable tray of claim 5 wherein said at least two parallel guides are slidably secured to said armchair stop by at least one widening rail.

10. The adjustable tray of claim 5 wherein said armchair stop further comprises:

an outer stopper groove; and an inner stopper groove;

wherein said rotational faster slides within the inner stopper groove and the outer stopper groove allow said platform to be positioned both horizontally and vertically.

11. The adjustable tray of claim 5 further comprising a plurality of retaining elements secured around a perimeter of said platform for preventing a mouse pad surface and other devices from slipping off said platform during use and storage.

12. The adjustable tray of claim 5 wherein said adjustable tray is selectively width and length adjustable to conform to a selected chair arm size.

13. The adjustable tray of claim 5 further comprising a rubberized surface disposed on said platform.

14. The adjustable tray of claim 5 wherein said armchair stop, said plurality of parallel guides, said plurality of vertical guides and said bottom support element have a cushioning material connected thereto.

15. An adjustable tray for use on a chair arm comprising:

a platform for providing a flat working surface, said platform defining at least one vertical slot; and an attachment body for securing said adjustable tray to said chair arm, said attachment body comprising:

a armchair stop wherein said armchair stop defines a cavity formed by an interconnecting outer stopper groove and an inner stopper groove wherein said armchair stop is pivotally connected to said platform by a rotational fastener through said at least one vertical slot, said armchair stop configured to allow said platform to slide and rotate in either direction of the horizontal plane and be stored vertically;

at least two parallel guides slidably secured to said armchair stop by at least one widening rail for receiving said arm of said chair;

at least two vertical guides slidably secured to said parallel guides by a plurality of lengthening rails wherein said two vertical guides further define an adjustable vertical slot; and a bottom support element wherein said bottom support element is secured between said vertical guides through said adjustable vertical slot by a fastener for adjusting to and receiving said bottom support element to differently sized and configured chair arms.

16. The adjustable platform of claim 15 further comprising a plurality of rail fasteners within said parallel guides for securing said parallel guides against said widening rail in a fixed position.

17. An adjustable tray, for use on a chair arm having a width dimension and a bottom surface, comprising:

a platform having a flat working surface, said platform selectively pivotally connected to an attachment body for securing said adjustable tray to said chair arm, said attachment body comprising:

an armchair stop for supporting and storing said platform wherein said armchair stop is pivotally adjustably connected to said platform by a rotational fastener allowing said platform to rotate in the horizontal plane and be stored in the vertical plane;

a plurality of parallel guides adjustably connected to said armchair stop to mount and secure the adjustable tray to fit the width dimension of said chair arm;

at least one compression element which passes around said parallel guides to compress and secure said parallel guides to said chair arm;

a plurality of vertical guides wherein said vertical guides further define an adjustable vertical slot;

a bottom support element;

a plurality of lengthening rails slidably securing said vertical guides to said parallel guides;

a fastener securing said bottom support element between said vertical guides through said adjustable vertical slot;

whereby said bottom support element may be adjusted to fit differently sized and configured chair arms.

18. An adjustable tray, for use on a chair arm, having a width dimension, and a bottom surface, comprising:

a platform having a flat working surface, said platform selectively pivotally connected to an attachment body for securing said adjustable tray to said chair arm, said attachment body comprising:

an armchair stop for supporting and storing said platform wherein said platform is pivotally adjustably connected to said armchair stop by a rotational fastener allowing said platform to rotate in a horizontal plane and be stored in a vertical plane;

at least two parallel guides adjustably connected to said armchair stop to mount and secure the adjustable tray to fit the width dimension of said chair arm;

at least one compression element which passes around said at least two parallel guides to compress and secure said parallel guides to said chair arm; and at least two vertical guides slidably secured to said parallel guides by a plurality of lengthening rails wherein said two vertical guides further define an adjustable vertical slot and a bottom support element wherein said bottom support element is secured between said vertical guides through said adjustable vertical slot by a fastener for adjusting to and receiving said bottom support element to differently sized and configured chair arms.

19. An adjustable tray, for use on a chair arm, having a width dimension, and a bottom surface, comprising:

a platform having a flat working surface, said platform selectively pivotally connected to an attachment body for securing said adjustable tray to said chair arm, said attachment body comprising:

an armchair stop for supporting and storing said platform wherein said platform is pivotally adjustably connected to said armchair stop by a rotational fastener allowing said platform to rotate in a horizontal plane and be stored in a vertical plane;

at least two parallel guides adjustably connected to said armchair stop to mount and secure the adjustable tray to fit the width dimension of said chair arm; and at least one compression element which passes around said at least two parallel guides to compress and secure said parallel guides to said chair arm, wherein said platform further defines at least one curved slot for allowing said platform to be selectively attached to said armchair stop through said slot.

* * * * *